United States Patent [19]

Wulf et al.

[11] 3,971,902

[45] July 27, 1976

[54] KEYBOARD SWITCH ASSEMBLY HAVING ONE PIECE PLURAL PUSHBUTTON ACTUATOR AND RESILIENT MOUNTING STRUCTURE FOR PLURAL CANTILEVER BEAM CONTACTS

[75] Inventors: LaVern Dale Wulf, Harrisburg; Henry William Demler, Jr., Lebanon, both of Pa.

[73] Assignee: AMP Incorporated, Harrisburg, Pa.

[22] Filed: Mar. 21, 1975

[21] Appl. No.: 560,858

[52] U.S. Cl. ..... 200/5 A; 200/159 A; 200/246; 200/283

[51] Int. Cl.[2] ..... H01H 13/14; H01H 1/28

[58] Field of Search ..... 200/5 R, 5 A, 5 E, 5 EB, 200/6 R, 6 B, 6 BB, 6 C, 159 R, 159 A, 159 B, 246, 283, 302, 329, 340, 6 BA

[56] References Cited

UNITED STATES PATENTS

| | | | |
|---|---|---|---|
| 1,867,870 | 7/1932 | Baker et al. | 200/5 A UX |
| 1,886,284 | 11/1932 | Luther | 200/5 A |
| 3,188,435 | 6/1965 | Rugsten | 200/246 |
| 3,299,241 | 1/1967 | Sayward | 200/246 |
| 3,472,974 | 10/1969 | McGough | 200/5 R |
| 3,602,677 | 8/1971 | Adelson et al. | 200/283 |
| 3,681,723 | 8/1972 | Goll | 200/159 B X |
| 3,684,842 | 8/1972 | Boulanger | 200/159 B X |
| 3,691,324 | 9/1972 | Brantingson | 200/5 E |
| 3,742,157 | 6/1973 | Leposavic | 200/159 B X |
| 3,760,137 | 9/1973 | Shimojo et al. | 200/159 B X |
| 3,819,882 | 6/1974 | Anderson et al. | 200/5 A X |
| 3,823,309 | 7/1974 | Caruso | 200/5 A X |
| 3,854,018 | 12/1974 | Reynolds et al. | 200/5 E X |
| 3,860,771 | 1/1975 | Lynn et al. | 200/5 R X |
| 3,870,840 | 3/1975 | Rivetta et al. | 200/5 A |

*Primary Examiner*—James R. Scott
*Attorney, Agent, or Firm*—Allan B. Osborne

[57] ABSTRACT

The present invention relates generally to keyboard systems and more particularly to an integral keyboard assembly which includes a plurality of keys, the bezel and the housing containing the contact strips sandwiched between the keys and a single sided printed circuit board on which are the conductive paths.

2 Claims, 3 Drawing Figures

KEYBOARD SWITCH ASSEMBLY HAVING ONE PIECE PLURAL PUSHBUTTON ACTUATOR AND RESILIENT MOUNTING STRUCTURE FOR PLURAL CANTILEVER BEAM CONTACTS

BACKGROUND OF THE INVENTION

The technological advances in recent years relative to electronic devices such as integrated circuits, transistors, semi-conductors and so forth have given rise to keyboard systems for use in transmitting information to such electronic devices. The information is transmitted in the form of electrical pulses generated by opening circuits. The opening is generally accomplished by depressing a key on the keyboard which brings two or more circuits into electrical contact one with the other whereby electric current flows from an energy source to the particular electronic device coupled to the system. As the costs of these electronic devices decreased coupled with an increase in the use and availability of various devices incorporating such; i.e., electronic calculators, credit card verifiers, point of sale recorders and so forth, the need for inexpensive and reliable keyboard systems have increased enormously. In addition to being inexpensive and reliable, systems are required which occupy a minimal amount of space without a loss in accuracy. Some of the factors determining the expense of a keyboard system includes the number of separate elements which must be manufactured and handled during assembly, the assembly routine and its adaptability to automation, and volume per unit time.

Accordingly, it is a object of the present invention to provide a keyboard system adapted for selectively establishing electrical interconnections in response to mechanical actuation.

It is another object of the present invention to provide an improved keyboard system which is expensive and reliable.

It is a further object of the present invention to provide a keyboard system which is substantial and shockproof and which can be fabricated on a mass production basis.

Still another object of the present invention is to provide a reliable keyboard system containing four distinct elements.

Various additional objects and advantages of the present invention will become readily apparent from the following detailed descriptions.

DESCRIPTION OF THE PREFERRED EMBODIMENT

Figure 1:
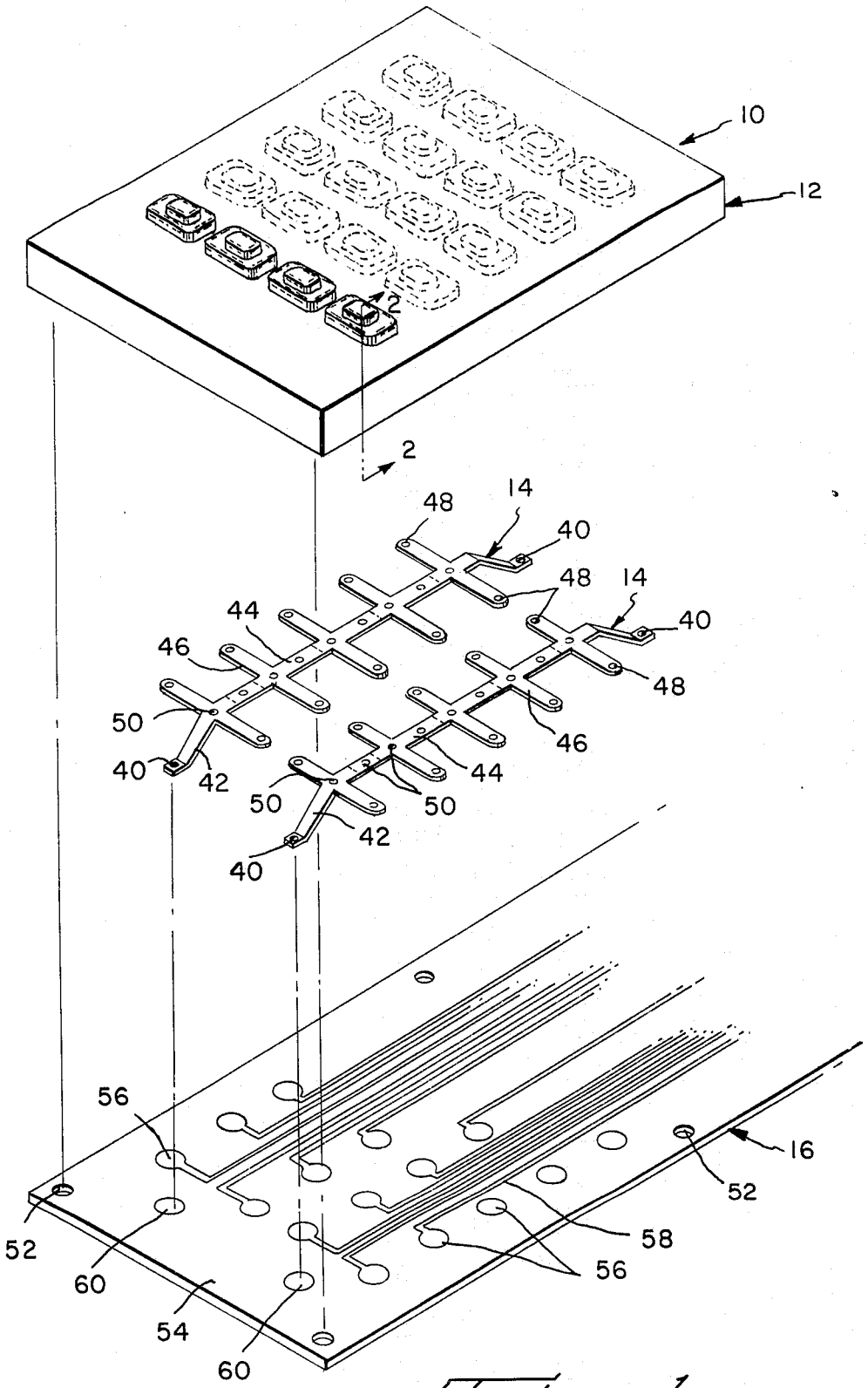
FIG. 1 is an exploded view of the keyboard system of the present invention.

In FIG. 1 the reference numeral 10 points to an assembled keyboard system which contains four discrete elements: the keyboard — bezel — housing integrated subassembly 12, two ladder-frame contact strips 14 and a printed circuit board 16 having circuits on the top surface only.

Figure 2:
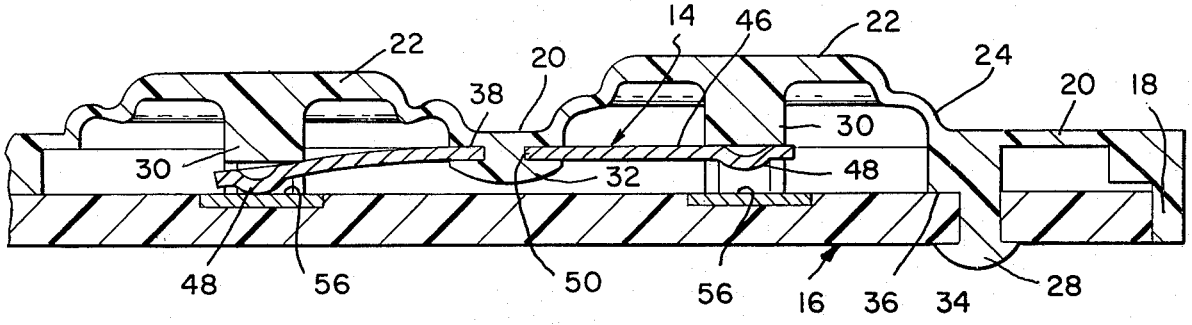
FIG. 2 is a cross-sectional view taken along lines 2—2 of FIG. 1.

The detail of the keyboard subassembly 12 can be seen in FIG. 2. This is a one-piece assembly molded from acrylic multipolymer a material having good resiliency.

The subassembly includes the outer depending walls 18, a flat portion 20 and keys 22. The keys have a convex perimeter which form integral spring members 24 and a flat top surface 26. The underside of the subassembly includes integral molded rivets 28, depending studs 30 located in the center of each key's underside and contact strip retaining snaps 32.

The rivets 28 have an enlarged head 34 and a downwardly facing shoulder 36 spaced a predetermined distance from the head. The retaining snaps 32 have an annular groove 38.

With reference to both FIGS. 1 and 2, ladder-frame contact strips 14 are stamped and formed from a conductive, resilient material such as tin copper alloy. Each end of the strip terminates in power contact 40. A leg 42 rises obliquely upwards to the ladder-frame which consists of a central bar 44 and lateral cantilever beams 46. Each beam terminates at its face end in a contact 48 which may be dimpled as shown in FIG. 2. The central bar 44 contains a plurality of apertures 50. Each contact strip 14 is snapped onto the underside of subassembly 12 by pushing the retaining snaps 32 through the apertures 50 until the central bar 44 seats in grooves 38. The legs 42 on the strips are depending from the subassembly. The dimensions of the contact strips 14 correspond to those of the subassembly 12 so that upon snapping the contact strip in place automatically aligns the contacts 48 with depending studs 30 on each key 22.

The printed circuit board 16 shown in FIGS. 1 and 2 contain a number of apertures 52 around the perimeter. On the top surface 54 a number of contacts 56 and conductive paths 58 are provided. The geometry of the contacts 56 corresond to that of the key arrangement in subassembly 12. The conductive paths lead to electronic devices (not shown) such as integrated circuits and the like. The power contacts 60; i.e., those that bring the current to the contact strips, are positioned on board 16 in geometric relation to the power contacts 40 on strip 14. Not shown on the board are the conductive paths leading to contacts 60 nor the energy souce.

Subsequent to snapping contact strips 14 into subassembly 12, the board 16 is fastened thereto by pushing the rivets 28 through apertures 56 such as seen in FIG. 2. Note that the board's thickness is such as to fit snugly between the rivet head 34 and shoulder 36. At the conclusion of this step, the keyboard assembly is complete and ready for insertion into an electronic calculator (not shown) or the like; i.e., the contacts 40 on strips 14 are in abutting electrical engagement with energy contacts 60 on board 16. The contacts 48 are elevated above contacts 56 on the board by reason of legs 42 but are in direct overlying relation thereto.

As a key 22 is depressed stud 30 pushes the underlying contact 48 down onto a contact 56 on board 16. Current in the contact strip 14 via energy contact 60 flows into contact 56 and connecting conductive path 58 and onto some electronic device (not shown). Concurrently, the downward pressure bends the cantilever beam 46 and the convex spring members 24 surrounding the key are stretched out of form as seen on the left-hand pushbutton in FIG. 2. When the pressure is released from key 22, the stretched spring members rebound, bringing the key back up to the position as seen on the right-hand key in FIG. 2. The cantilever beam 46 also regains its normal horizontal position.

Figure 3:
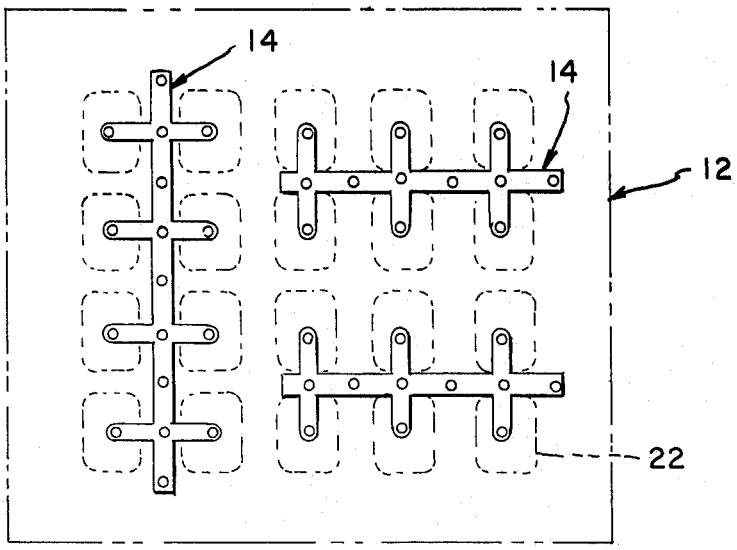
FIG. 3 illustrates a second arrangement of the contact strips utilized in the keyboard system of the present invention.

FIG. 3 shows one of many permutations that can be achieved using the present invention. Illustrated therein are three separate units, each of which contain a number of keys, etc. The contact strips 14 can be cut at any point to fit into a tailor-made keyboard subassembly and printed circuit board.

In summary, the present invention provides a keyboard assembly consisting of a unitary keyboard assembly wherein the individual keys and the spring members are integral units and not separate pieces. The keyboard systems thus offers a completely closed top assembly.

The keyboard assembly disclosed herein represents a minimal parts and ease in assembly.

Further, the contact strip concept is novel and offers a wide choice of configurations.

The foregoing detailed description has been given for clearness of understanding only, and no unnecessary limitations should be understood therefrom, as some modifications will be obvious to those skilled in the art.

What is claimed is:

1. A data entry keyboard system, comprising: a. a base member of insulating material having deposited thereon a plurality of spaced, first electrical contacts arranged in two spaced, parallel rows, and a second electrical contact positioned at an end of and between the two rows, said first and second contacts adapted for connection to electrical circuits;

b. an electrically conductive and resilient contact strip having an elongated central bar with depending legs at either end and cantilever beams spaced along either side of and laterally extending from the central bar, said legs being fixed to the base member with one leg in engagement with the second electrical contact and with the central bar and cantilever beams spaced above the plurality of first electrical contacts with the ends of the beam being in alignment therewith, and further said central bar having a plurality of apertures spaced therealong; and c. a single molded sheet of resilient material positioned over the contact strip and fastened to the base member at the edges thereof to define a cavity containing the contact strip, said molded sheet having on its upper surface a plurality of raised portions forming keys with a molded convex perimeter around each key and positioned intermediate the surface of the key and surface of the molded sheet, said convex perimeter biasing the key away from the base member, and a plurality of depending studs each positioned under a key and in alignment with the ends of the cantilever beams so that as a key is depressed the stud pushes the end of the beam into contact with the first electrical contact positioned therebelow so that an electrical circuit may be completed between the first electrical contact and the second electrical contact, further said molded sheet having depending therefrom a plurality of retaining means adapted to be received in the apertures so as to attach the central bar to the molded sheet, said retaining means having a resiliently deformable nose of greater diameter than the aperture and an annular groove behind the nose to receive the wall defining the aperture.

2. The data entry keyboard system of claim 1 further including another second electrical contact positioned at another end of the parallel row of first electrical contacts and adapted for engagement with the second leg on the contact strip and further adapted for connection to an electrical circuit common to the second electrical contact positioned at the opposite end of the parallel rows.

* * * * *